US008297792B1

(12) United States Patent
Wang

(10) Patent No.: US 8,297,792 B1
(45) Date of Patent: Oct. 30, 2012

(54) LED LAMP WITH ADJUSTABLE PROJECTION ANGLE

(75) Inventor: Chin-Wen Wang, Pingzhen (TW)

(73) Assignee: Leader Trend Technology Corp., Taoyuan (TW)

( * ) Notice: Subject to any disclaimer, the term of this patent is extended or adjusted under 35 U.S.C. 154(b) by 67 days.

(21) Appl. No.: 13/105,962

(22) Filed: May 12, 2011

(51) Int. Cl.
*F21V 21/00* (2006.01)

(52) U.S. Cl. ..... 362/249.03; 362/427; 362/287; 362/294; 362/547

(58) Field of Classification Search ..... 362/249.02, 362/249.03, 282, 428, 285, 287, 294, 373, 362/545, 547
See application file for complete search history.

(56) References Cited

U.S. PATENT DOCUMENTS

2010/0277906 A1* 11/2010 Choi et al. ..... 362/235
2011/0002132 A1* 1/2011 Park ..... 362/429
2011/0133670 A1* 6/2011 Lee et al. ..... 315/294
2012/0008329 A1* 1/2012 Wang ..... 362/372

* cited by examiner

*Primary Examiner* — Ali Alavi
(74) *Attorney, Agent, or Firm* — Chun-Ming Shih; HDLS IPR Services

(57) ABSTRACT

An LED lamp with adjustable projection angle is installed to a lamp pole and includes a fixture, a pivot element, a pressing element, a heat dissipating lamp holder and an LED module. The fixture includes a transverse pipe and a cut groove formed at the transverse pipe. The pivot element is passed through the transverse pipe and pivotally coupled to the fixture. The pressing element is installed to the transverse pipe and provided for reducing the cut groove to press and clamp the pivot element. The heat dissipating lamp holder is mounted to the pivot element. The LED module is installed at the heat dissipating lamp holder, and the transverse pipe is used for adjusting the angle of elevation of the heat dissipating lamp holder and the LED module. Therefore, the road lamp can be adjusted to a required projection range to enhance the use efficiency of the road lamp.

15 Claims, 15 Drawing Sheets

LED LAMP WITH ADJUSTABLE PROJECTION ANGLE

FIELD OF THE INVENTION

The present invention relates to a lamp structure, in particular to a light emitting diode (LED) lamp with adjustable projection angle.

BACKGROUND OF THE INVENTION

Conventional incandescent bulbs, mercury lamps or light emitting diode lamps, particularly high-power lamps, such as road lamps, spot lights, and large decorative or advertising lamps have the drawbacks of high power consumption, large volume, and high price. As the light emitting diode (LED) technology is well developed, LED has the features of small volume, high efficiency, power saving, and dimmable light, and thus the LED gradually replaces the conventional incandescent bulbs and mercury lamps and becomes a mainstream product of the related market and used extensively in the illumination field.

With reference to FIG. 1 for a conventional road lamp, the road lamp comprises a road lamp pole 10 and a lamp 20, and an end of the road lamp pole 10 is fixed to the ground on a road, and the other end of the road lamp pole is coupled to the lamp 20, and a connecting position 30 of the road lamp pole 10 and the lamp 20 is fixed and cannot be moved or rotated, such that the light of the lamp 20 can be projected to a fixed area 40 below the lamp 20, wherein the lamp 20 can be a conventional incandescent bulb, mercury lamp or light emitting diode, and usually comes with one light emitting diode, and the lamp 20 has the features of high projection efficiency and large projection range, and the lamp 20 can project light to the fixed area 40 in a broad range.

However, the light emitting diode generally has low projection efficiency, so that when the light emitting diode is installed at a higher position, the projection range is very limited, and the projection range of the lamp 20 of the road lamp structure on the fixed area 40 is reduced. If the LED is used as the lamp 20, it is necessary to adjust the fixed area 40 to the desired area effectively. In the meantime, the conventional lamp 20 is fixed to the connecting position 30 and cannot be moved or rotated, so that when the road lamp pole 10 is tilted or bent, the fixed area 40 illuminated by the lamp 20 will be changed and the road lamp will fail to maximize its performance. Now, the only solution is to change the road lamp pole 10 which will waste unnecessary costs and labor.

In view of the foregoing drawbacks of the prior art, the inventor of the present invention based on years of experience in the related industry to conduct extensive researches and experiments, and finally overcome the drawbacks of the prior art by providing an LED lamp with adjustable projection angle in accordance with the present invention.

SUMMARY OF THE INVENTION

Therefore, it is a primary objective of the present invention to provide an LED lamp with adjustable projection angle, and the road lamp is capable of adjusting its projection angle to enhance the use efficiency of the road lamp.

To achieve the foregoing objective, the present invention provides an LED lamp with adjustable projection angle, comprising: a fixture, having a transverse pipe, and a cut groove formed on the transverse pipe; a pivot element, passed and installed to the transverse pipe, for pivotally coupling the pivot element to the fixture; a pressing element, installed to the transverse pipe, for reducing the cut groove to press and clamp the pivot element; a heat dissipating lamp holder, mounted to the pivot element; and an LED module, installed to the heat dissipating lamp holder, and the transverse pipe being used as a center for adjusting an angle of elevation of the heat dissipating lamp holder and the LED module.

The present invention further achieves the following effects: The fixture and the pivot element are provided for adjusting the angle of elevation of the heat dissipating lamp holder and the LED module by using the transverse pipe as a center, such that the LED road lamp of the present invention with a simple structure can achieve the effects of adjusting the projection angle of the road lamp and enhancing the use efficiency of the road lamp. In addition, the pressing element is provided for adjusting the volume of a hollow interior space, such that the hollow body can press and clamp the axial portions, and the LED road lamp of the present invention can be assembled easily to facilitate the manufacturing and assembling processes, even if the precision of components used for manufacturing the road lamp is not as high. The invention also has the feature of adjusting the angle of elevation of the LED road lamp with a stepless design, and another pressing element is provided for adjusting the volume of the interior space of the sleeve, such that the sleeve can press and clamp the lamp pole, so as to improve the convenience for maintenance people to install the road lamp of the present invention according to the different-sized peripheries of the lamp poles. In addition, the angle of elevation of the heat dissipating lamp holder and the LED module can be adjusted by using the transverse pipe as the center, so that the projection angle of the road lamp can be adjusted to project lights to the required area. If the lamp pole is tilted or bent, the road lamp can still adjust its projection angle to the original set area to avoid a change of the lamp pole and an unnecessary waste of cost and labor.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 1:
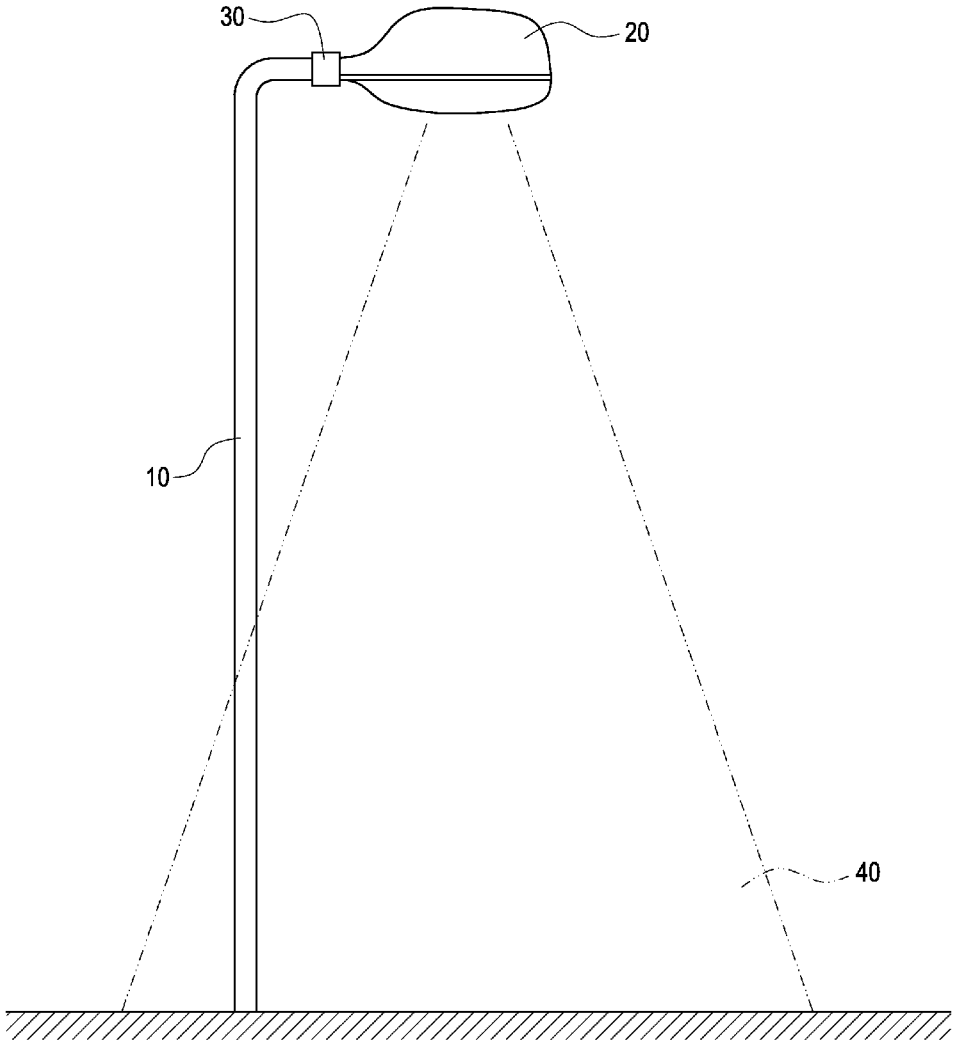
FIG.1 PRIOR ART
FIG. 1 is a schematic view of an application of a conventional LED road lamp.
Figure 2:
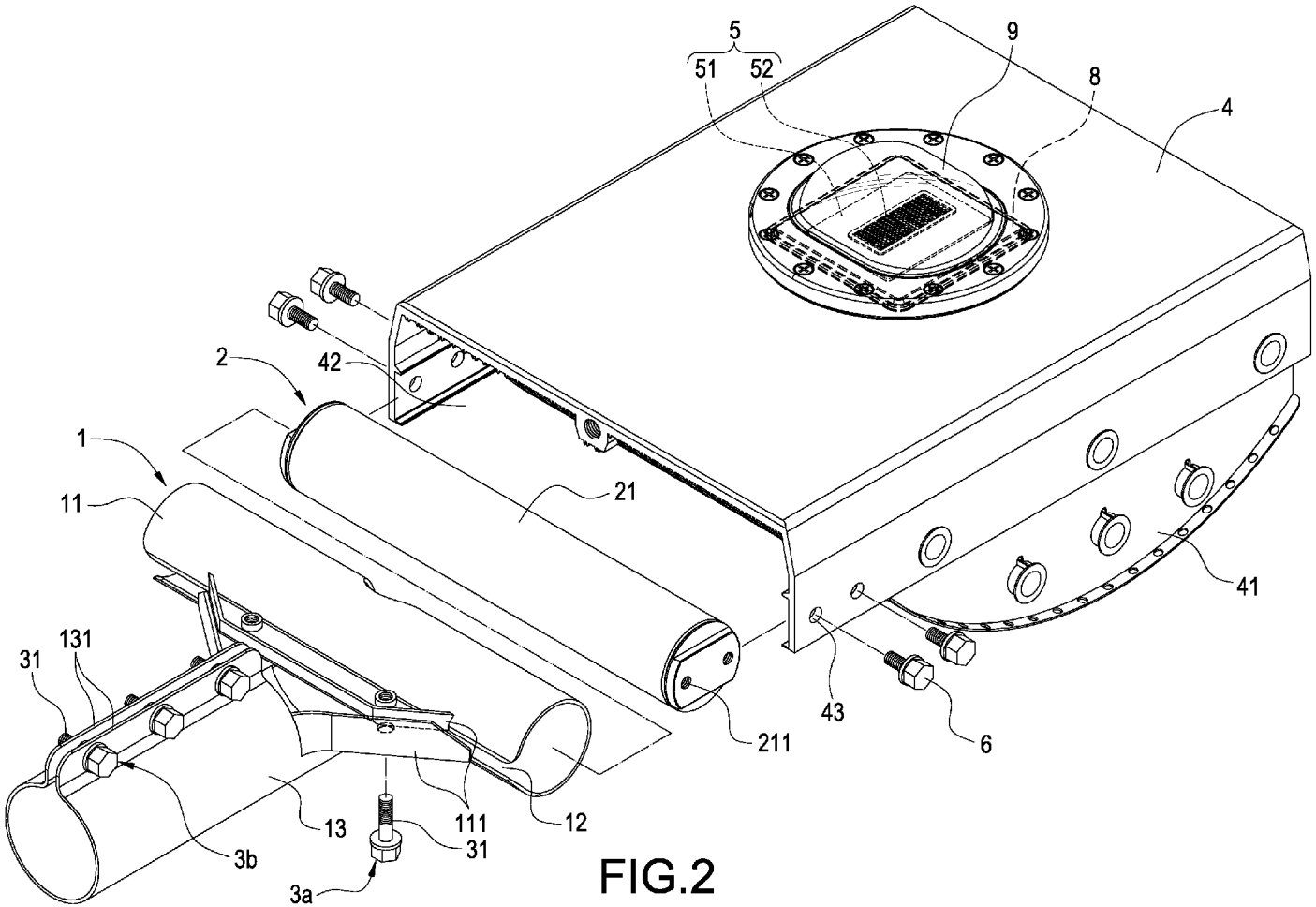
FIG. 2 is an exploded view of an LED road lamp in accordance with the present invention.
Figure 3:
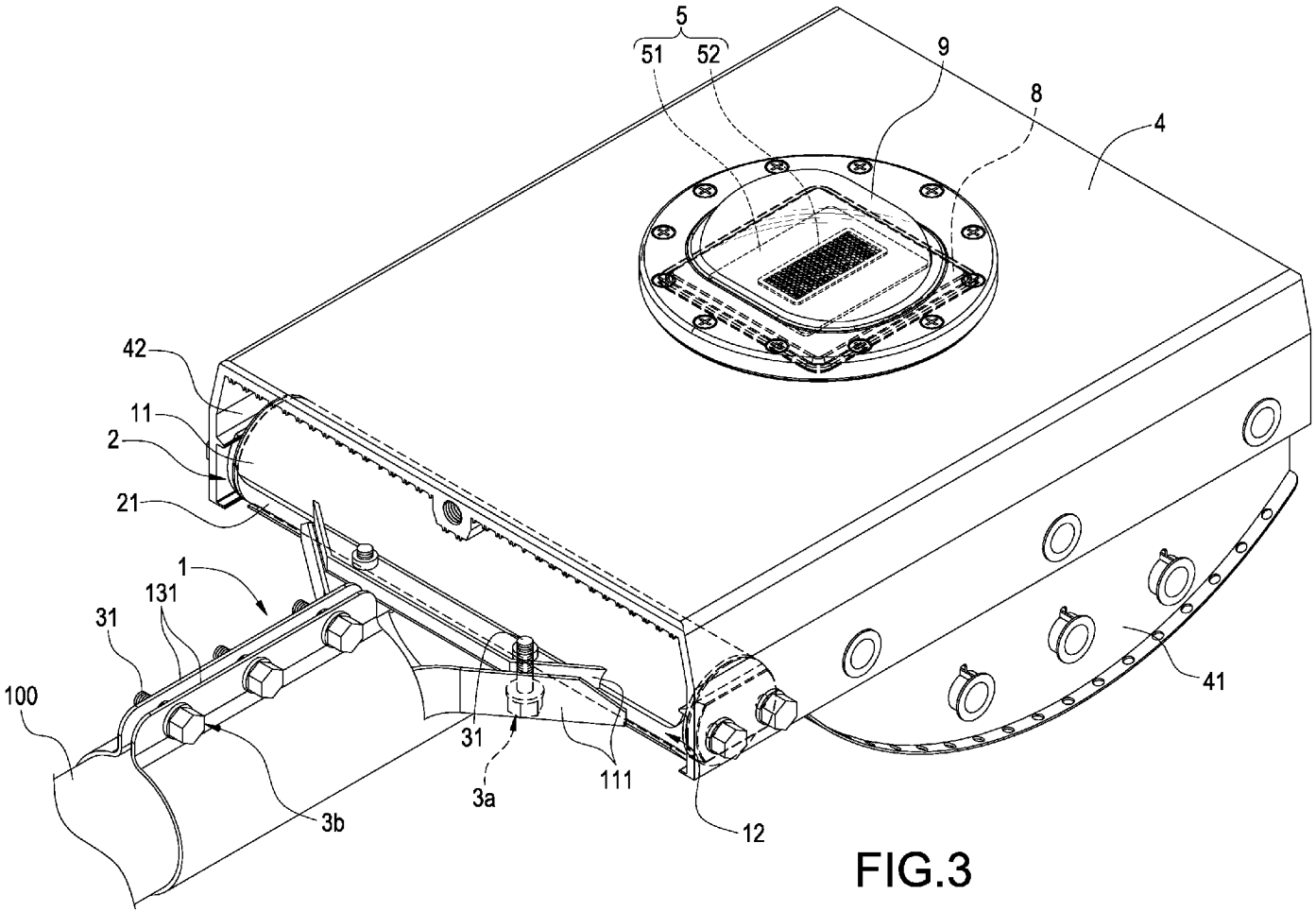
FIG. 3 is a perspective view of an LED road lamp in accordance with the present invention.
Figure 4:
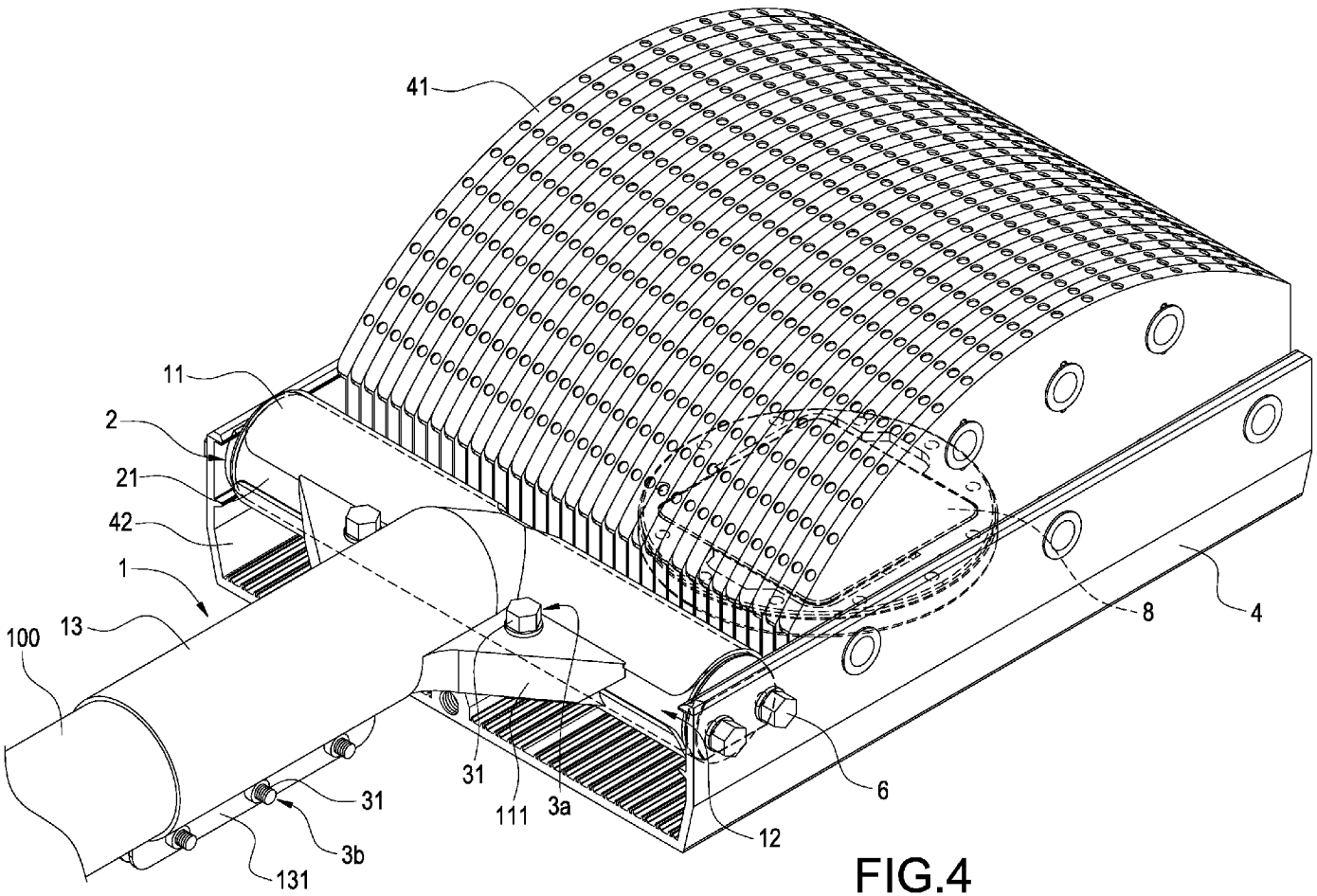
FIG. 4 is another perspective view of an LED road lamp in accordance with the present invention.

With reference to FIGS. 2 to 4 for an LED lamp with adjustable projection angle in accordance with the present invention, the LED lamp is installed to a lamp pole 100, and the LED road lamp comprises a fixture 1, a pivot element 2, a pressing element 3*a*, a heat dissipating lamp holder 4 and a LED module 5.

The fixture 1 is installed to the lamp pole 100, and the fixture 1 includes a transverse pipe 11 and a cut groove 12 formed on the transverse pipe 11, and the transverse pipe 11 has a cut edge section 111 protruded from both sides of the periphery of the transverse pipe 11 separately, and the cut groove 12 is formed between the two cut edge sections 111, and the fixture 1 includes a sleeve 13 disposed on a side away from the transverse pipe 11 and perpendicular to the transverse pipe 11 and sheathed and fixed onto the lamp pole 100, and the sleeve 13 includes a flange section 131 disposed on both sides of the periphery of the flange section 131 separately.

The pivot element 2 is passed and installed to the transverse pipe 11, such that the pivot element 2 is pivotally coupled to the fixture 1. The pivot element 2 comprises a cylindrical rod 21 and a hole 211 formed on both sides of the cylindrical rod 21 separately, and the cylindrical rod 21 is passed into the transverse pipe 11 and pivotally coupled to the transverse pipe 11, such that the holes 211 are exposed from both ends of the transverse pipe 11 respectively.

The pressing element 3*a* is installed to the transverse pipe 11 and provided for adjusting the cut groove 12, such that the transverse pipe 11 can press and clamp the cylindrical rod 21. More specifically, the pressing element 3*a* is installed to the two cut edge sections 111 and provided for adjusting the interval of the cut groove 12, so that the transverse pipe 11 can press and clamp the cylindrical rod 21. In addition, the pressing element 3*a* can be a locking element 31 such as a screw-and-bolt assembly, but the invention is not limited to such arrangement only. The locking element 31 is sheathed and fixed onto the two cut edge sections 111 and provided for adjusting the interval between the two cut edge sections 111 to adjust the volume of the interior space of the transverse pipe 11.

The heat dissipating lamp holder 4 is fixed and coupled to the pivot element 2, and the heat dissipating lamp holder 4 includes a plurality of heat dissipating fins 41 extended from a side of the heat dissipating lamp holder 4, a slot 42, and an opening 43 formed on both sides of the slot 42 respectively, and the heat dissipating fins 41 can be aluminum extruded heat dissipating fins, such that the heat dissipating lamp holder 4 is an aluminum extruded heat dissipating lamp holder, but the present invention is not limited to such arrangement only. The transverse pipe 11 is contained in the slot 42, and the cylindrical rod 21 is passed into the transverse pipe 11.

The LED module 5 installed to the other side of the heat dissipating lamp holder 4 having the heat dissipating fins 41, while the heat dissipating fins 41 are extended in a direction away from the LED module 5. The LED module 5 includes a circuit board 51 and one or more light emitting elements 52 installed on the circuit board 51.

The present invention further comprises another pressing element 3*b* installed to the two flange sections 131 and provided for adjusting the sleeve 13 to press and clamp the lamp pole 100. More specifically, the pressing element 3*b* can be a locking element 31 such as a screw-and-bolt assembly, but the invention is not limited to such arrangement only. The locking element 31 is fixed and fixed to the two flange sections 131 and provided for adjusting the interval between the two flange sections 131 to adjust the volume of the interior space of the sleeve 13.

The present invention further comprises two connecting elements 6 passed, each being fixed to each opening 42 and each hole 211, and each connecting element 6 is a screw, and each hole 211 has an internal thread, and each connecting element 6 is secured to each corresponding hole 211 to combine the heat dissipating lamp holder 4 with both sides of the cylindrical rod 21.

The present invention further comprises a vapor chamber 8 and a lampshade 9, wherein the vapor chamber 8 is clamped between the heat dissipating lamp holder 4 and the LED module 5 for uniformly conducting the heat generated by the LED module 5 to the heat dissipating lamp holder 4, and the lampshade 9 is fixed to the heat dissipating lamp holder 4 and covered onto the LED module 5.

The assembly of the LED road lamp of the present invention adopts the cylindrical rod 21 passed into the transverse pipe 11 and the heat dissipating lamp holder 4 fixed to both sides of the cylindrical rod 21 to adjust the angle of elevation of the heat dissipating lamp holder 4 and the LED module 5 by using the transverse pipe 11 as the center. More specifically, the pivot element 2 includes a cylindrical rod 21 and a hole 211 formed on both sides of the cylindrical rod 21 separately. The fixture 1 is installed to the two flange sections 131 by the pressing element 3*b*, and the distance between the two flange sections 131 is adjusted to drive the sleeve 13 to press and clamp the lamp pole 100, and the fixture 1 is installed to the two cut edge sections 111 by the pressing element 3*a* to adjust the interval of the cut groove 12, such that the transverse pipe 11 can press and clamp the cylindrical rod 21, and the cylindrical rod 21 is passed to the transverse pipe 11 and pivotally coupled to the transverse pipe 11. The heat dissipating lamp holder 4 has an opening 43 formed on both sides of the slot 42 separately, and each connecting element 6 is passed into each opening 42 and secured to each corresponding hole 211, such that the heat dissipating lamp holder 4 can be combined to both sides of the cylindrical rod 21. The LED module 5 is installed to the heat dissipating lamp holder 4, such that the angle of elevation of the heat dissipating lamp holder 4 and the LED module 5 can be achieved by the fixture 1 and the pivot element 2 by using the transverse pipe 11 as the center, and the LED road lamp of the present invention with a simple structure can achieve the effects of adjusting the projection angle of the road lamp and enhancing the use efficiency of the road lamp.

Figure 5:
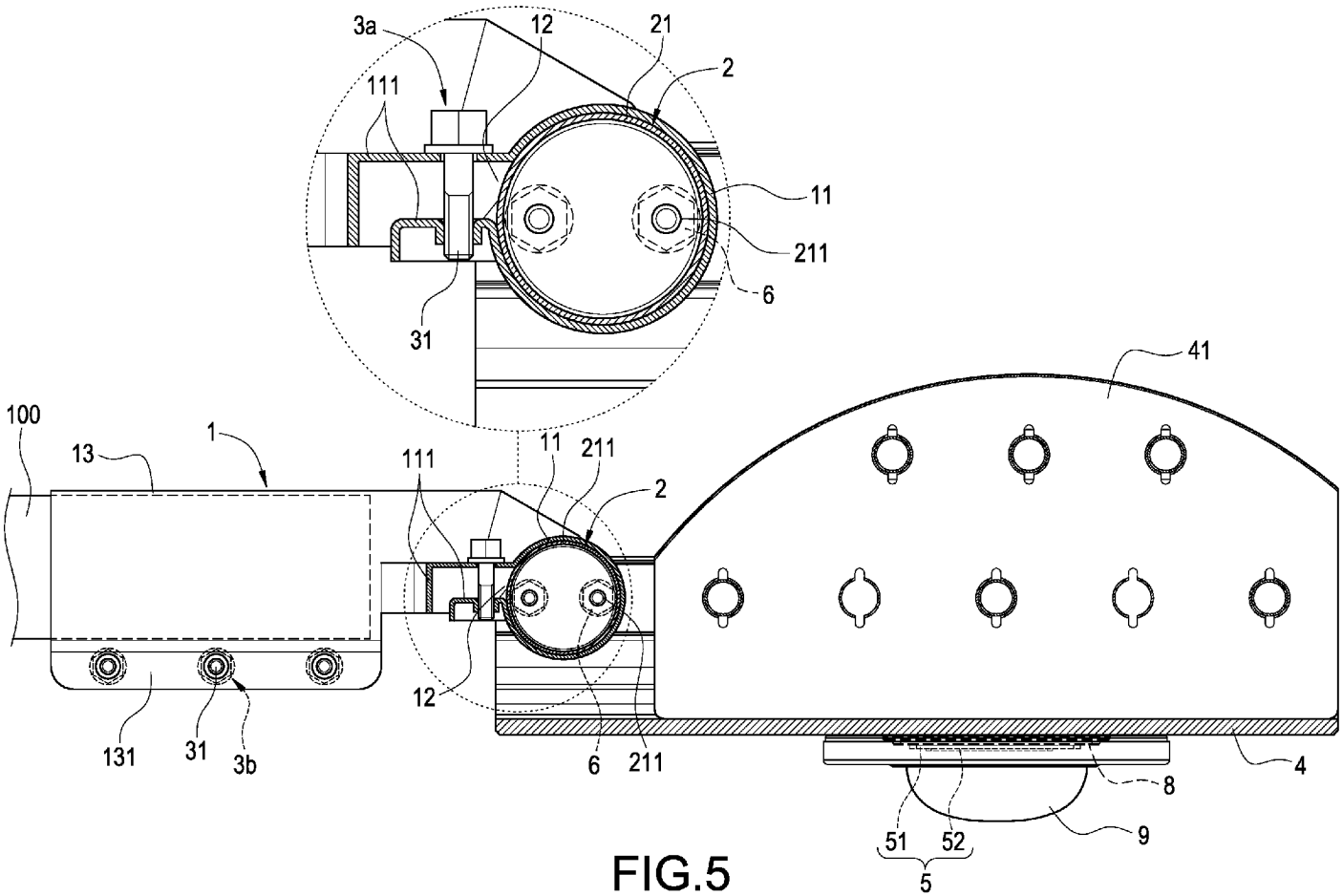
FIG. 5 is a side view of assembling an LED road lamp in accordance with the present invention.
Figure 6:
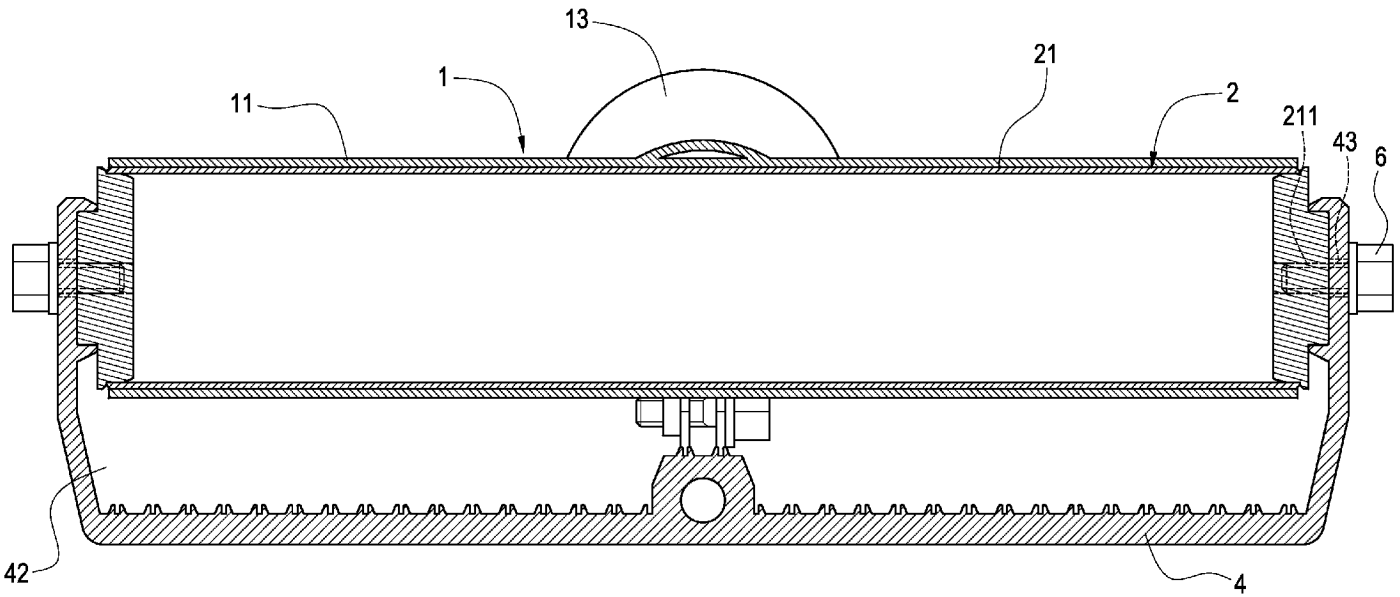
FIG. 6 is another side view of assembling an LED road lamp in accordance with the present invention.

With reference to FIG. 5 for a schematic view of assembling an LED road lamp of the present invention, the transverse pipe 11 has a cut edge section 111 protruded from both sides of the periphery of the transverse pipe 11 separately, such that the transverse pipe 11 has a U-shaped cross-section, and the pressing element 3*a* is installed to the two cut edge sections 111 and provided for adjusting the distance of the cut groove 12 formed between the two cut edge sections 111 to adjust the volume of the interior space of the transverse pipe 11, and the transverse pipe 11 presses and clamps the cylindrical rod 21. Therefore, the LED road lamp of the present invention can sheath the transverse pipe 11 on the cylindrical rod 21, so that they can be assembled to each other easily to facilitate the manufacturing and assembling processes, even if the manufacturing precision of the components is not as high. In the meantime, the present invention uses the pressing element 3*a* to adjust the interior space of the transverse pipe 11 in order to clamp the cylindrical rod 21. The LED road lamp of the present invention provides an easy way of adjusting the angle of elevation of the LED road lamp with a stepless adjustment.

Similarly, the sleeve 13 has a flange section 131 extended from both sides of the periphery of the sleeve 13 separately, and the pressing element 3*b* is installed to the two flange sections 131 and provided for adjusting the distance between the two flange sections 131 to adjust the volume of the interior space of the sleeve 13, such that the sleeve 13 can press and clamp the lamp pole 100, and the LED road lamp of the present invention can be applicable to the lamp poles 100 of different sizes or diameters to improve the convenience for maintenance people to install the road lamps.

With reference to FIG. 5 for another schematic view of assembling an LED road lamp of the present invention, the heat dissipating lamp holder 4 includes a slot 42 and an opening 43 formed on both sides of the slot 42 separately, and the connecting element 6 is a screw, but the invention is not limited to such arrangement only. The cylindrical rod 21 is passed into the transverse pipe 11, and the transverse pipe 11 is contained in the slot 42, and each connecting element 6 is passed into each corresponding opening 43 and secured to each corresponding hole 211, such that the heat dissipating lamp holder 4 can be mounted securely onto both sides of the cylindrical rod 21, and the overall road lamp of the present invention LED provides a convenient assembly and a highly stable structure.

Figure 7:
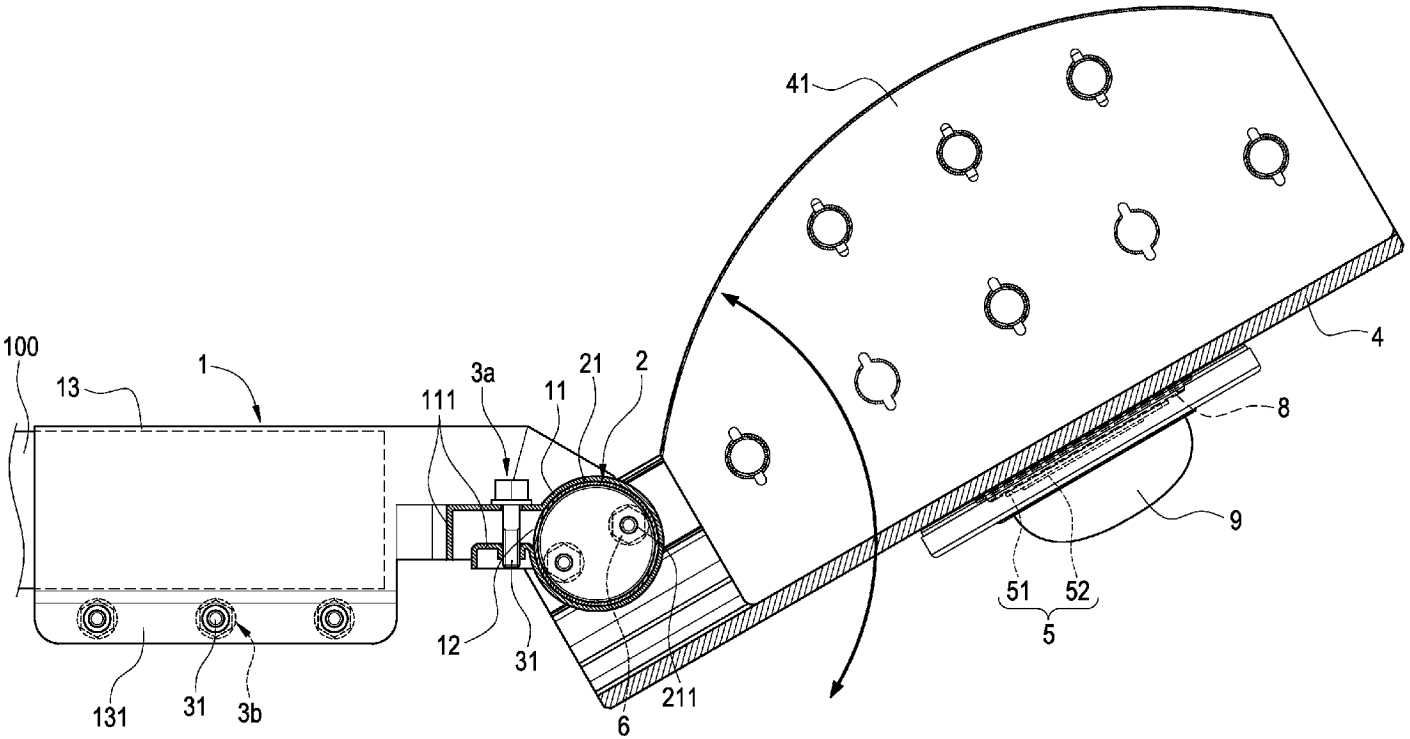
FIG. 7 is a schematic view of an application of an LED road lamp in accordance with the present invention.
Figure 8:
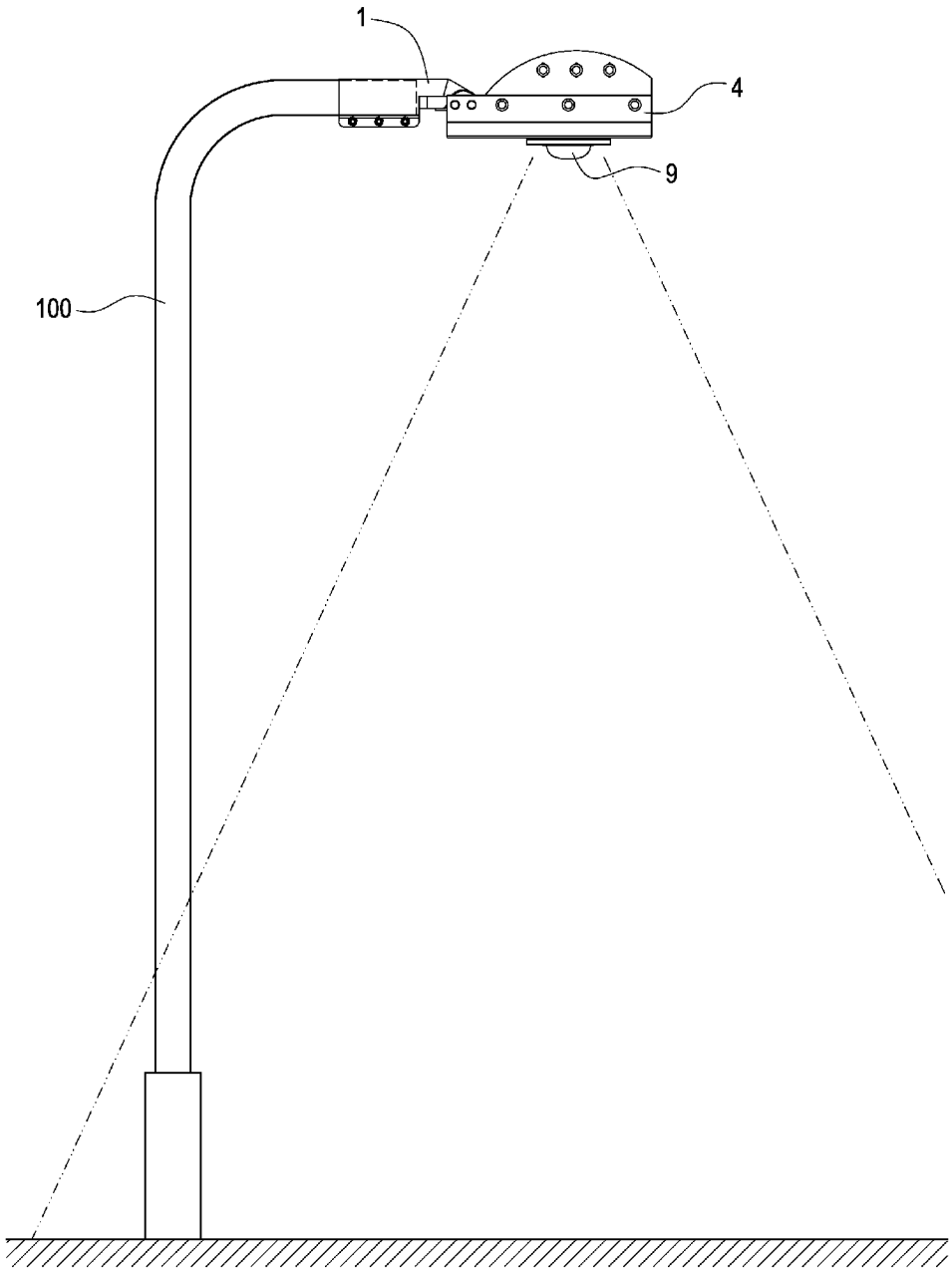
FIG. 8 is a schematic view of another application of an LED road lamp in accordance with another preferred embodiment of the present invention.

With reference to FIGS. 7 and 8 for schematic views of using an LED road lamp of the present invention, the transverse pipe 11 has a cut edge section 111 protruded from both sides of the periphery of the transverse pipe 11 separately, such that the transverse pipe 11 has a U-shaped cross-section, and the pressing element 3*a* is installed to the two cut edge sections 111 and provided for adjusting the distance of the cut groove 12 formed between the two cut edge sections 111 to adjust the volume of the interior space of the transverse pipe 11, and the transverse pipe 11 presses and clamps the cylindrical rod 21, and the angle of elevation of the heat dissipating lamp holder 4 and the LED module 5 can be adjusted by using the transverse pipe 11 as the center. Therefore, the road lamp can adjust its projection angle to illuminate the required area effectively. In addition, if the lamp pole 100 is tilted or bent by external collisions, the projection angle of the road lamp of the present invention LED can be adjusted to illuminate the original set area, so as to avoid a change of the lamp pole 100 or an unnecessary waste of cost and labor.

Figure 9:
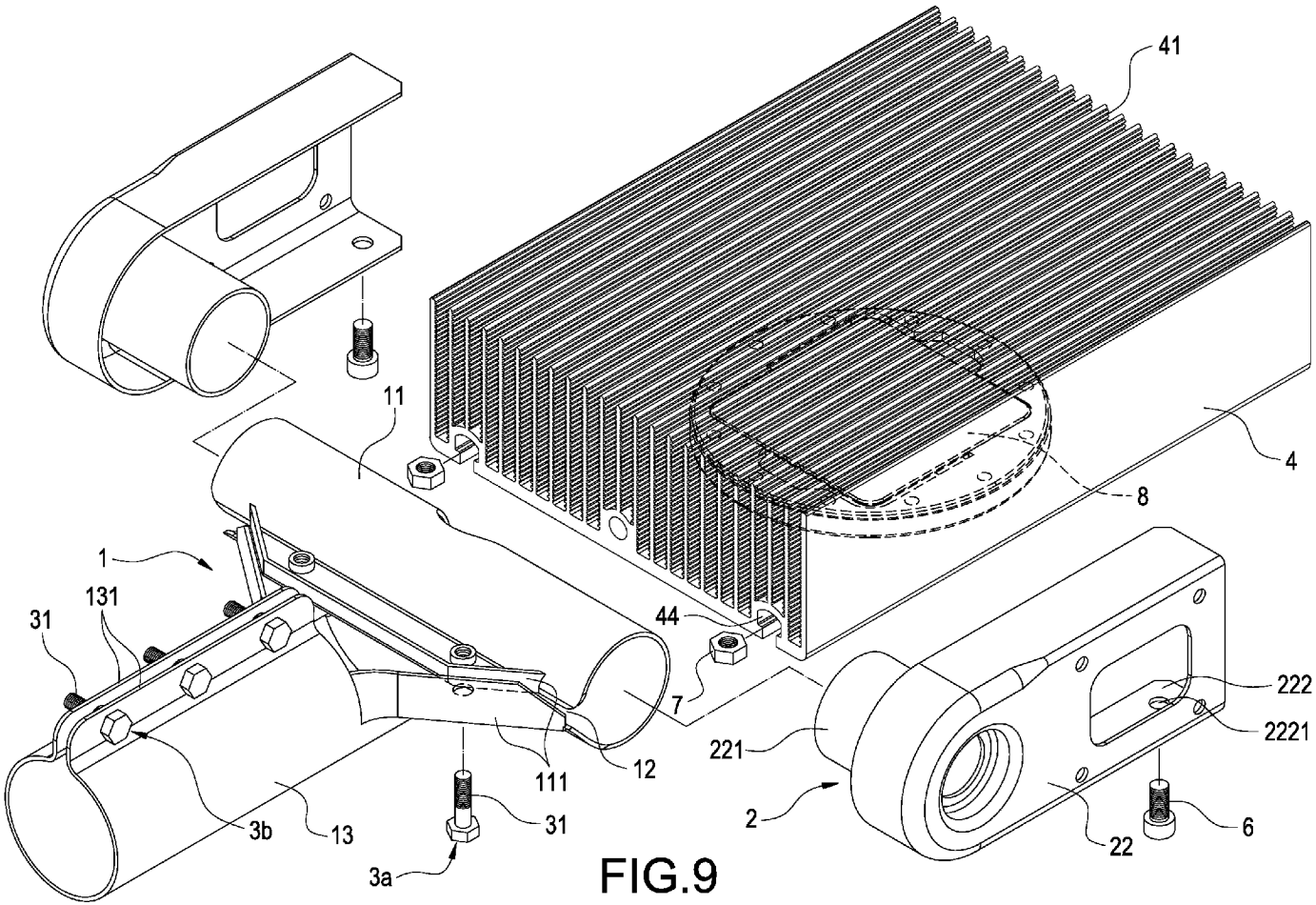
FIG. 9 is an exploded view of an LED road lamp in accordance with another preferred embodiment of the present invention.
Figure 10:
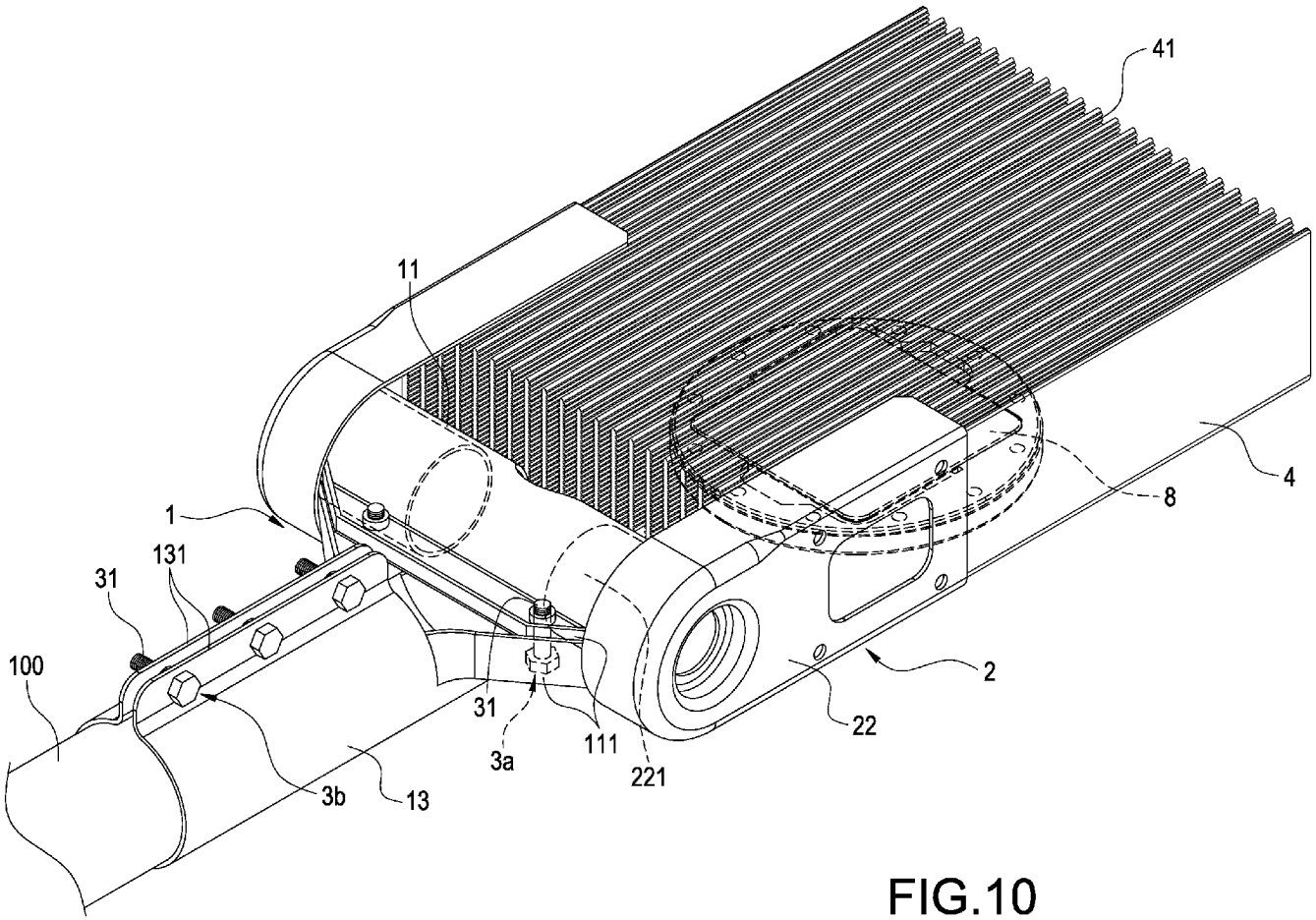
FIG. 10 is a perspective view of an LED road lamp in accordance with another preferred embodiment of the present invention.
Figure 11:
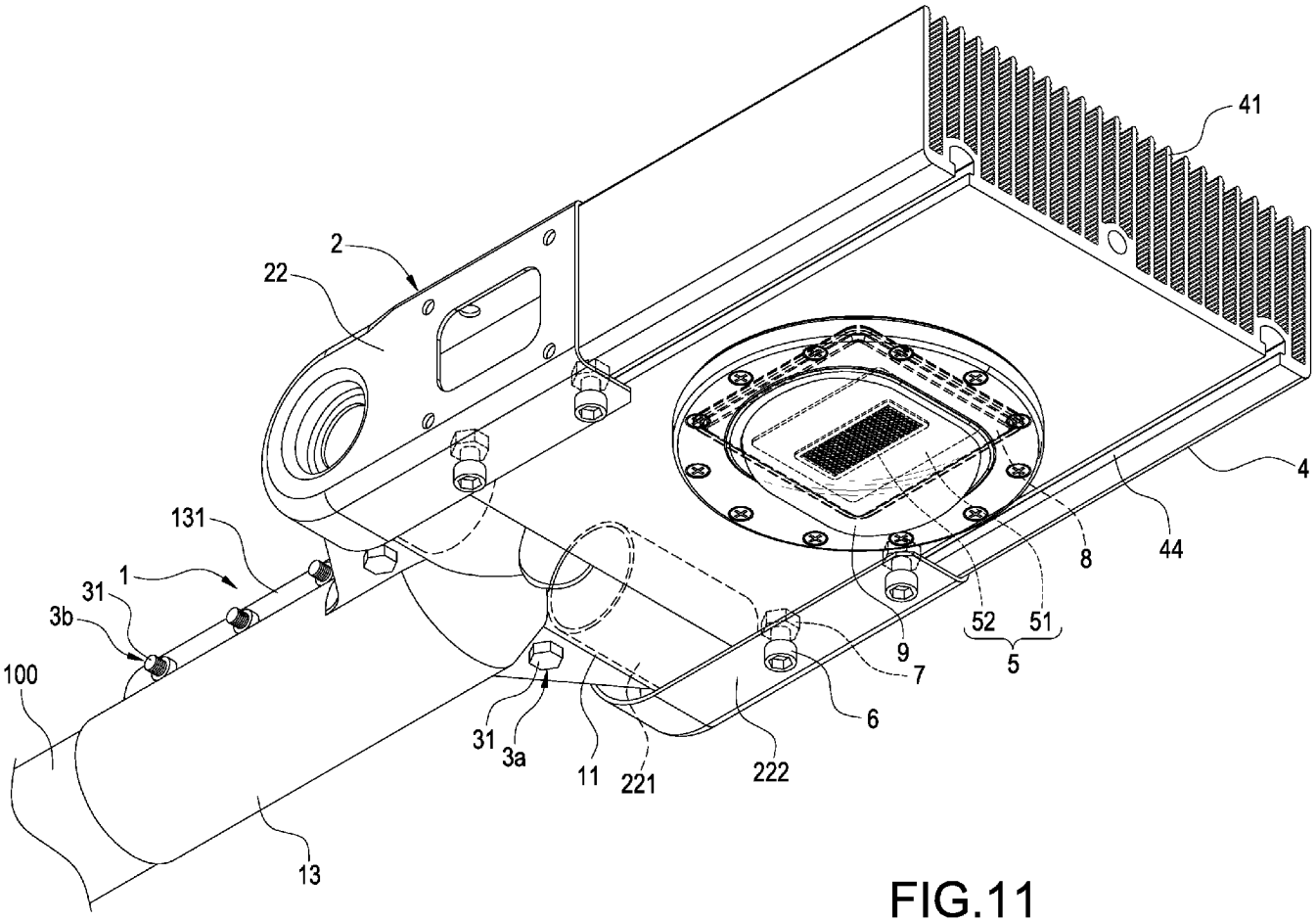
FIG. 11 is another perspective view of an LED road lamp in accordance with another preferred embodiment of the present invention.

With reference to FIGS. 9 to 11 for an LED road lamp in accordance with another preferred embodiment of the present invention, the LED road lamp is installed to a lamp pole 100, and the LED road lamp comprises a fixture 1, a pivot element 2, a pressing element 3*a*, a heat dissipating lamp holder 4 and a LED module 5.

The fixture 1 is installed to the lamp pole 100, and the fixture 1 includes a transverse pipe 11 and a cut groove 12 formed on the transverse pipe 11, and the transverse pipe 11 has a cut edge section 111 protruded from both sides of the periphery of the transverse pipe 11 separately, and the cut groove 12 is formed between the two cut edge sections 111, and the fixture 1 includes a sleeve 13 disposed on a side away from the transverse pipe 11 and perpendicular to the transverse pipe 11 and sheathed and fixed onto the lamp pole 100, and the sleeve 13 includes a flange section 131 disposed on both sides of the periphery of the flange section 131 separately.

The pivot element 2 is passed and installed to the transverse pipe 11, such that the pivot element 2 is pivotally coupled to the fixture 1. More specifically, the pivot element 2 includes two brackets 22 pivotally coupled to both ends of the transverse pipe 11 respectively, wherein each bracket 22 has an axial portion 221 formed on a side of the bracket 22 and a carrying section 222 formed at the other side of the bracket 22, and the carrying section 222 has a penetrating hole 2221, and the two axial portions 221 are respectively and pivotally coupled to both ends of the transverse pipe 11.

The pressing element 3*a* is installed to the transverse pipe 11 and provided for adjusting the cut groove 12, such that the transverse pipe 11 presses and clamps the axial portion 221. More specifically, the pressing element 3*a* is installed to the two cut edge sections 111 and provided for adjusting the interval of the cut groove 12 to drive the transverse pipe 11 to press and clamp the two axial portions 221. In addition, the pressing element 3*a* is a locking element 31 such as a screw-and-bolt assembly, but the invention is not limited to such arrangement only. The locking element 31 is passed and fixed to the two cut edge sections 111 and provided for adjusting the distance between the two cut edge sections 111 to adjust the volume of the interior space of the transverse pipe 11.

The heat dissipating lamp holder 4 is fixed to the pivot element 2, and the heat dissipating lamp holder 4 includes a plurality of heat dissipating fins 41 extended from a side of the heat dissipating lamp holder 4, wherein the heat dissipating fins 41 are aluminum extruded heat dissipating fins, and thus the heat dissipating lamp holder 4 is an aluminum extruded heat dissipating lamp holder, but the invention is not limited to such arrangement only. The heat dissipating lamp holder 4 includes two ditches 44 formed on the other side away from the heat dissipating fins 41.

The LED module 5 is installed at a position of the heat dissipating lamp holder 4 and away from the heat dissipating fins 41, while the heat dissipating fins 41 are extended in a direction away from the LED module 5, and the LED module 5 includes a circuit board 51 and one or more light emitting elements 52 installed on the circuit board 51.

The present invention further comprises another pressing element 3*b* installed at the two flange sections 131 and provided for adjusting the sleeve 13 to press and clamp the lamp pole 100. More specifically, the pressing element 3*b* is a locking element 31 such as a screw-and-bolt assembly, but the invention is not limited to such arrangement only. The locking element 31 is passed and fixed to the two flange sections 131 and provided for adjusting the distance between the two flange sections 131 to adjust the volume of the interior space of the sleeve 13.

The present invention further comprises two fixing elements 7 and two connecting elements 6, and each fixing element 7 is latched into each ditch 44, and each connecting element 6 is passed into each penetrating hole 2221, and the two connecting elements 6 are combined with the two corresponding fixing elements 7 respectively, such that the heat dissipating lamp holder 4 is fixed to the carrying section 222 and clamped between the two brackets 222, wherein the fixing element 7 is a bolt, and the connecting element 6 is a screw, but the invention is not limited to such arrangement only.

The present invention further comprises a vapor chamber 8 and a lampshade 9, wherein the vapor chamber 8 is clamped between the heat dissipating lamp holder 4 and the LED module 5 for uniformly conducting the heat generated by the LED module 5 to the heat dissipating lamp holder 4, and the lampshade 9 is fixed to the heat dissipating lamp holder 4 and covered onto the LED module 5.

The assembly of the LED road lamp of the present invention pivotally couples a side of the bracket 22 to the transverse pipe 11 and the other side of the bracket 22 to the heat dissipating lamp holder 4, so that the angle of elevation of the heat dissipating lamp holder 4 and the LED module 5 can be adjusted by using the transverse pipe 11 as the center. More specifically, the pivot element 2 includes two brackets 22, and each bracket 22 has an axial portion 221 and a penetrating hole 2221, and the fixture 1 is installed to the two flange sections 131 by the pressing element **3*b* for adjusting the distance between the two flange sections 131 to press and clamp the sleeve 13 to the lamp pole 100, and the fixture 1 is installed to the two cut edge sections 111 by the pressing element 3*a* and provided for adjusting the interval of the cut groove 12 to drive the transverse pipe 11 to press and clamp the two axial portions 221, such that the two axial portions 221 are pivotally coupled to both ends of the transverse pipe 11 respectively, and the heat dissipating lamp holder 4 is fixed to the carrying section 222 and clamped between the two brackets 22, and the LED module 5 is installed to the heat dissipating lamp holder 4, so that the angle of elevation of the heat dissipating lamp holder 4 and the LED module 5 can be adjusted by the fixture 1 and the pivot element 2 by using the transverse pipe 11** as the center. The LED road lamp of the present invention with a simple structure can achieve the effects of adjusting the projection angle of the road lamp and enhancing the use efficiency of the road lamp.

Figure 12:
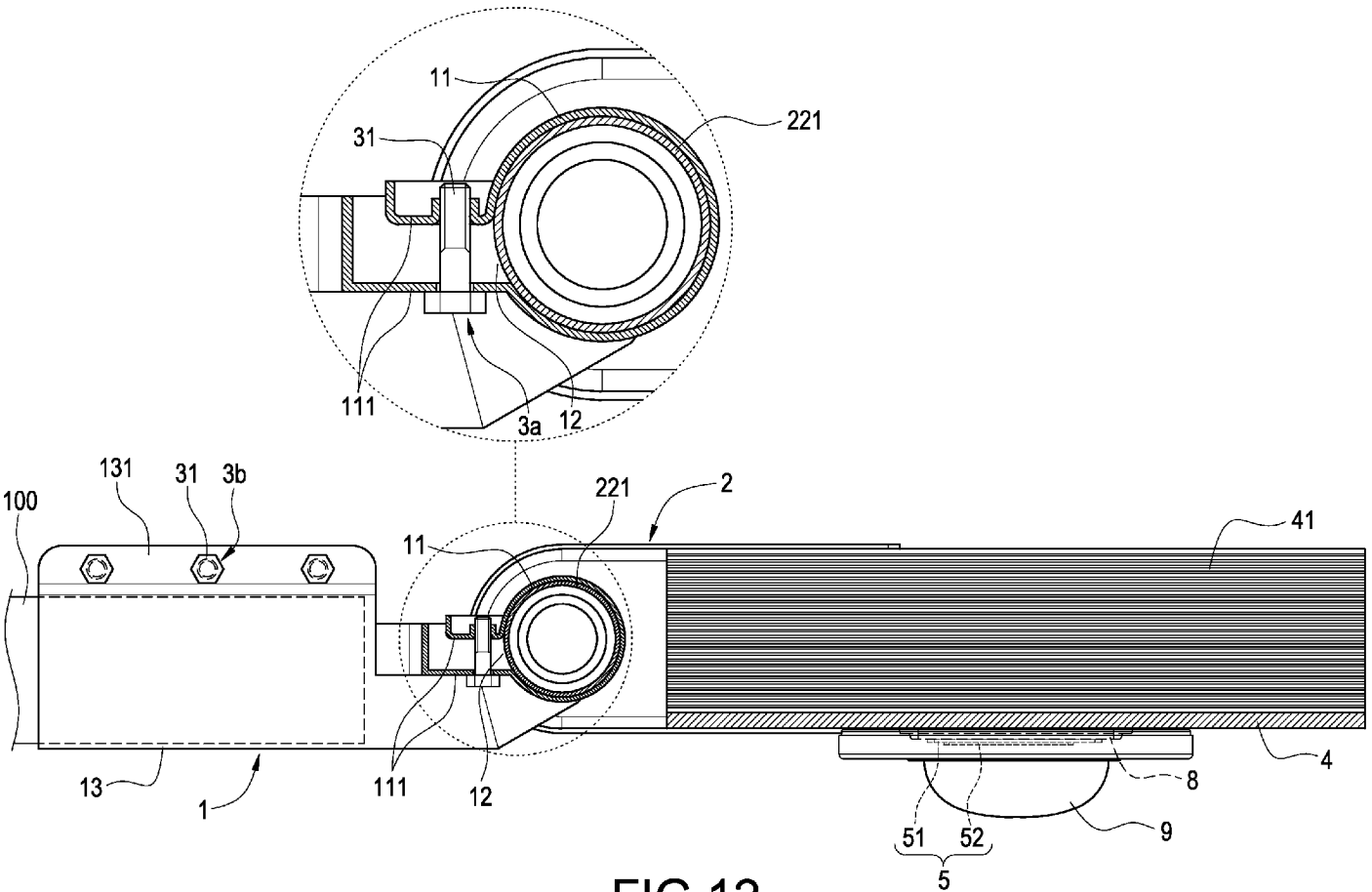
FIG. 12 is a side view of assembling an LED road lamp in accordance with another preferred embodiment of the present invention.

With reference to FIG. 12 for a schematic view of assembling an LED road lamp in accordance with another preferred embodiment of the present invention, the transverse pipe 11 has a cut edge section 111 protruded from both sides of the periphery of the transverse pipe 11, such that the transverse pipe 11 has a U-shaped cross-section, and the pressing element **3*a* is installed to the two cut edge sections 111 and provided for adjusting the distance of the cut groove 12 formed between the two cut edge sections 111 to adjust the volume of the interior space of the transverse pipe 11, and the transverse pipe 11 presses and clamps the cylindrical rod 21. Therefore, the LED road lamp of the present invention can sheath the transverse pipe 11 on the two axial portions 221, and they can be assembled to each other easily to facilitate the manufacturing and assembling processes even if the manufacturing precision of the components is not as high. In the meantime, the present invention uses the pressing element 3*a* to adjust the interior space of the transverse pipe 11 in order to clamp the two axial portions 221**. Therefore, the LED road lamp of the present invention provides an easy way of adjusting the angle of elevation of the LED road lamp with a stepless adjustment.

Similarly, the sleeve 13 has a flange section 131 extended from both sides of the periphery of the sleeve 13 separately, and the pressing element **3*b* is installed to the two flange sections 131 and provided for adjusting the distance between the two flange sections 131 to adjust the volume of the interior space of the sleeve 13, such that the sleeve 13 can press and clamp the lamp pole 100, and the LED road lamp of the present invention can be applicable for the lamp poles 100** of different sizes or diameters, so as to improve the convenience for maintenance people to install the road lamps.

Figure 13:
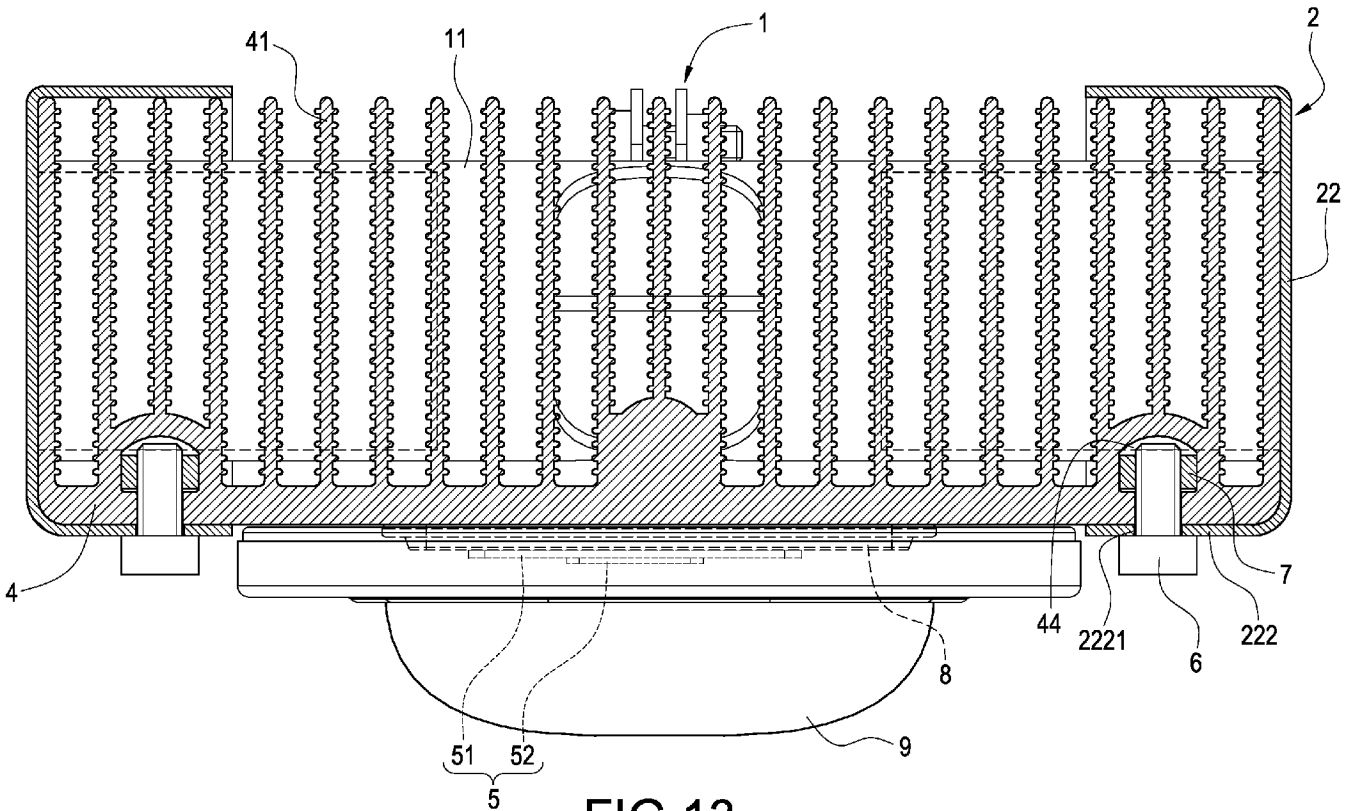
FIG. 13 is another side view of assembling an LED road lamp in accordance with another preferred embodiment of the present invention.

With reference to FIG. 13 for another schematic view of assembling an LED road lamp in accordance with another preferred embodiment of the present invention, the fixing element 7 is a bolt, and the connecting element 6 is a screw, but the invention is not limited to such arrangement only. Each fixing element 7 is latched into each ditch 44 and passed into each penetrating hole 2221, and the two connecting elements 6 are combined with two corresponding fixing elements 7 respectively, such that the heat dissipating lamp holder 4 can be secured to the carrying section 222 and clamped between the two brackets 22, and the overall LED road lamp of the present invention provides a very convenient assembly and a highly stable structure.

Figure 14:
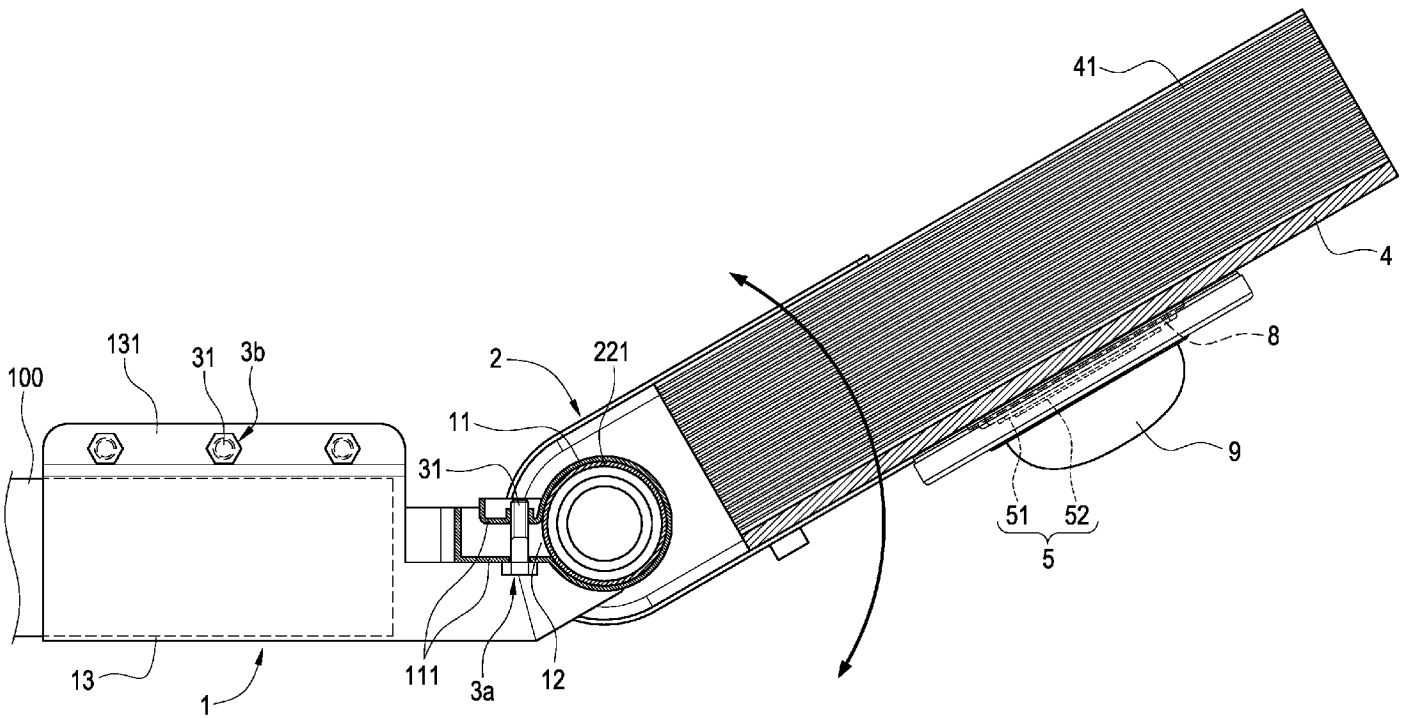
FIG. 14 is a schematic view of an application of an LED road lamp in accordance with another preferred embodiment of the present invention.
Figure 15:
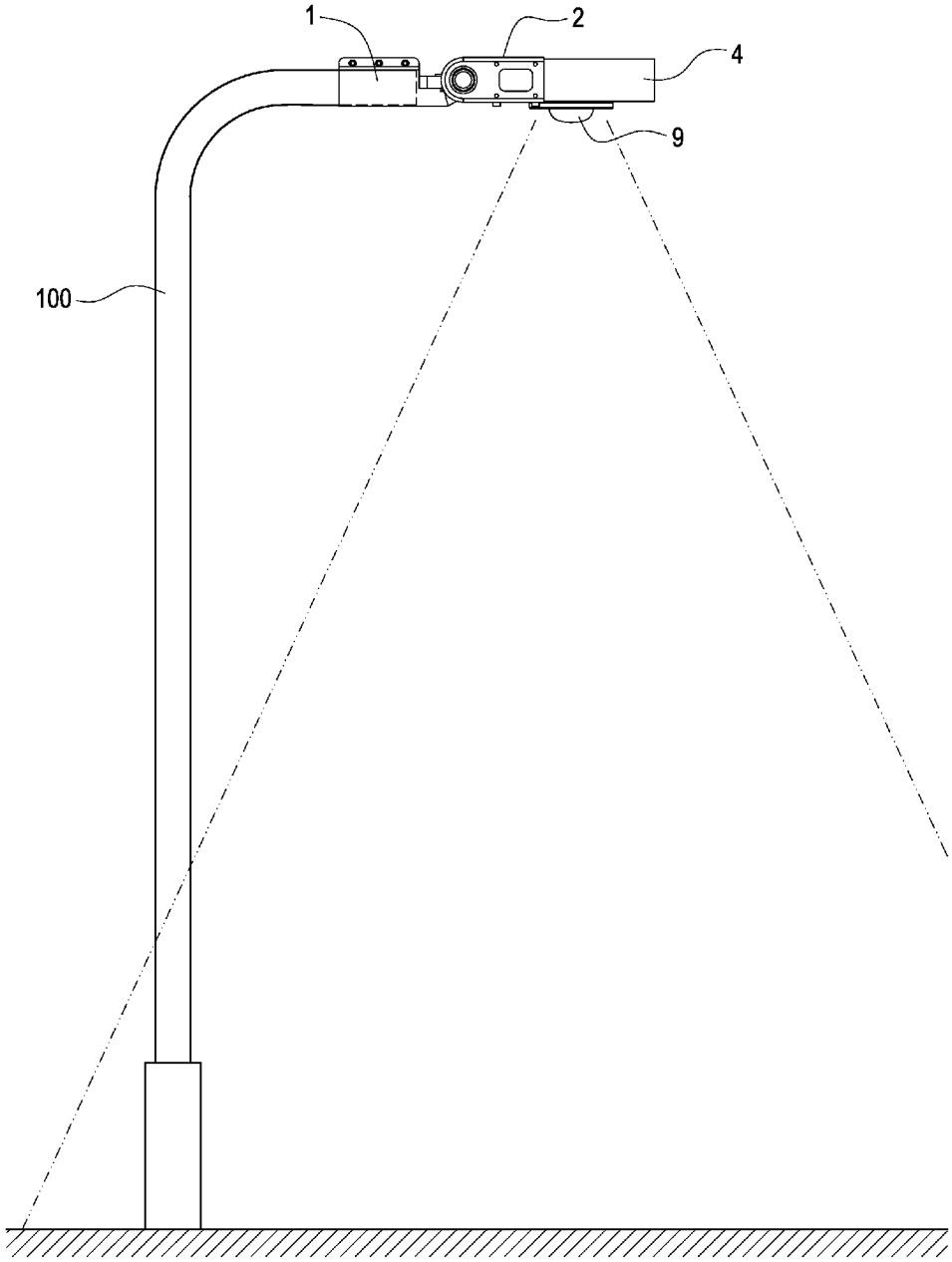
FIG. 15 is a schematic view of another application of an LED road lamp in accordance with another preferred embodiment of the present invention.

With reference to FIGS. 14 and 15 for schematic views of using an LED road lamp of the present invention, the transverse pipe 11 has a cut edge section 111 protruded from both sides of the periphery of the transverse pipe 11 separately, such that the transverse pipe 11 has a U-shaped cross-section, and the pressing element **3*a* is installed to the two cut edge sections 111 and provided for adjusting the distance of the cut groove 12 formed between the two cut edge sections 111 to adjust the volume of the interior space of the transverse pipe 11, and the transverse pipe 11 presses and clamps the two axial portions 221, and the angle of elevation of the heat dissipating lamp holder 4 and the LED module 5 can be adjusted by using the transverse pipe 11 as the center. Therefore, the road lamp can adjust its projection angle to illuminate the required area effectively. In addition, if the lamp pole 100 is tilted or bent by external collisions, the projection angle of the road lamp of the present invention LED can be adjusted to illuminate the original set area, so as to avoid a change of the lamp pole 100** or an unnecessary waste of cost and labor.

In summation of the description above, the LED lamp with adjustable projection angle of the present invention improves over the prior art and complies with the patent application requirements, and thus is duly filed for patent application.

What is claimed is:

1. A light emitting diode (LED) lamp with adjustable projection angle, comprising:

a fixture, having a transverse pipe, and a cut groove formed on the transverse pipe;

a pivot element, passed and installed to the transverse pipe, for pivotally coupling the pivot element to the fixture;

a pressing element, installed to the transverse pipe, for reducing the cut groove to press and clamp the pivot element;

a heat dissipating lamp holder, mounted to the pivot element; and an LED module, installed to the heat dissipating lamp holder, and the transverse pipe being used as a center for adjusting an angle of elevation of the heat dissipating lamp holder and the LED module.

2. The LED lamp with adjustable projection angle as recited in claim 1, wherein the transverse pipe has a cut edge section protruded separately from both sides of the periphery of the transverse pipe, and the cut groove is formed between the two cut edge sections, and the pressing element is installed to the two cut edge sections for adjusting an interval of the cut groove.

3. The LED lamp with adjustable projection angle as recited in claim 2, wherein the pressing element is a locking element, and the locking element is passed and fixed to the two cut edge sections.

4. The LED lamp with adjustable projection angle as recited in claim 1, wherein the pivot element includes a cylindrical rod, and the heat dissipating lamp holder includes a slot, and the cylindrical rod is passed through and pivotally coupled to the transverse pipe.

5. The LED lamp with adjustable projection angle as recited in claim 4, further comprising two connecting elements, and the cylindrical rod having a hole formed separately on both sides of the cylindrical rod, and the heat dissipating lamp holder having an opening formed separately on both sides of the slot, and each of the connecting elements being passed through and fixed to each of the opening and each of the hole respectively for combining the cylindrical rod and the heat dissipating lamp holder.

6. The LED lamp with adjustable projection angle as recited in claim 1, wherein the pivot element includes two brackets, and each of the brackets has an axial portion, and two axial portions of the brackets are pivotally coupled to both ends of the transverse pipe respectively.

7. The LED lamp with adjustable projection angle as recited in claim 6, further comprising two connecting elements and two fixing elements, and the heat dissipating lamp holder having two ditches, and each of the bracket having a penetrating hole, and each of the connecting element being passed through each of the penetrating holes, and each of the fixing elements being latched to each of the ditches, and each of the connecting elements being combined with each of the corresponding fixing elements.

8. The LED lamp with adjustable projection angle as recited in claim 7, wherein the bracket has a carrying section and the penetrating hole is formed at the carrying section and provided for mounting the heat dissipating lamp holder to the carrying section.

9. The LED lamp with adjustable projection angle as recited in claim 1, wherein the fixture has a sleeve disposed on a side away from the transverse pipe, and the sleeve is perpendicular to the transverse pipe.

10. The LED lamp with adjustable projection angle as recited in claim 9, further comprising another pressing element, and the sleeve has a flange section extended separately from both sides of the periphery of the sleeve, and the other pressing element is installed at the two flange sections.

11. The LED lamp with adjustable projection angle as recited in claim 10, wherein the other pressing element is a locking element, and the locking element is passed through and fixed to the two flange sections and provided for adjusting the interval between the two flange sections.

12. The LED lamp with adjustable projection angle as recited in claim 1, further comprising a vapor chamber, and the vapor chamber being clamped between the heat dissipating lamp holder and the LED module.

13. The LED lamp with adjustable projection angle as recited in claim 1, further comprising a lampshade covered onto the LED module.

14. The LED lamp with adjustable projection angle as recited in claim 1, wherein the heat dissipating lamp holder includes a plurality of heat dissipating fins extended in a direction away from the LED module.

15. The LED lamp with adjustable projection angle as recited in claim 1, wherein the LED module includes a circuit board and a light emitting element installed on the circuit board.

* * * * *